US009502822B1

(12) United States Patent
Huang

(10) Patent No.: US 9,502,822 B1
(45) Date of Patent: Nov. 22, 2016

(54) BALL-LOCK AXIAL CONNECTOR ASSEMBLY

(71) Applicant: Chung-Chuan Huang, Tainan (TW)

(72) Inventor: Chung-Chuan Huang, Tainan (TW)

( * ) Notice: Subject to any disclaimer, the term of this patent is extended or adjusted under 35 U.S.C. 154(b) by 0 days.

(21) Appl. No.: 14/955,423

(22) Filed: Dec. 1, 2015

(51) Int. Cl.
*H01R 4/50* (2006.01)
*H01R 13/627* (2006.01)
*H01R 24/38* (2011.01)

(52) U.S. Cl.
CPC ..... *H01R 13/6276* (2013.01); *H01R 24/38* (2013.01)

(58) Field of Classification Search
CPC .. H01R 13/6276; H01R 24/38; H01R 13/53; H01R 13/621; H01R 4/36
USPC ..... 439/348
See application file for complete search history.

(56) References Cited

U.S. PATENT DOCUMENTS 8,814,608 B2 * 8/2014 Song ..... H01R 4/36 439/108
8,939,785 B2 * 1/2015 Chiu ..... H01R 13/621 439/333
9,203,182 B2 * 12/2015 Fawcett ..... H01R 13/53
2004/0121641 A1 * 6/2004 Fawcett ..... H01R 13/629 439/348
2010/0059341 A1 * 3/2010 Itoh ..... B65G 23/08 198/788
2013/0052855 A1 * 2/2013 Komatsubara ..... H01R 13/6276 439/348

* cited by examiner

*Primary Examiner* — Jean F Duverne
(74) *Attorney, Agent, or Firm* — Rosenberg, Klein & Lee

(57) ABSTRACT

A ball-lock axial connector assembly includes a receiving member, and a sleeve having one end is received in the receiving member. The sleeve has three apertures defined radially through the wall thereof so as to receive a bead in each of the apertures. A portion of the bead is located within the sleeve. A guide face extends from each of the apertures and toward the receiving member. A positioning member and a push member are mounted to the sleeve. A first resilient member is biased between the positioning member and the push member. The push member has three protrusions which extend through the positioning member and contact the beads respectively. A case is movably mounted to the positioning member and the push member. A second resilient member is located between the bead and the receiving member. The beads are pushed to be removed from the apertures by pushing the case.

10 Claims, 6 Drawing Sheets

BALL-LOCK AXIAL CONNECTOR ASSEMBLY

BACKGROUND OF THE INVENTION

1. Fields of the Invention

The present invention relates to an axial connector assembly, and more particularly, to a ball-lock axial connector assembly for easily separating the connector and the receiving member.

2. Descriptions of Related Art

The conventional axial connector assemblies are used to electrically connect between electric parts or appliances. The connectional axial connector assemblies are designed to be easily manufactured and assembled. Some of the connectional axial connector assemblies use threads or plug/groove to be connect the axial connector and the receiving member. The plug/groove has an inherent problem of wearing out, and the threads require the assemblers to connect the axial connector and the receiving member by manual ways.

A conventional axial connector assembly known to applicant is disclosed in U.S. Pat. No. 8,764,473 which includes engagement balls installed to the receiving member and when the engagement ball is pushed, the leading end part is moved by the engagement ball so that the engagement ball is moved toward radially such that the axial connector is able to be connected to the receiving member. The engagement ball is then moved back to its original position by the resilient force of the leading end part and is engaged with the recessed part of the axial connector.

When the axial connector is removed from the receiving member, the outer sleeve is moved and pushes the leading end part to allow the engagement ball not to be biased by the protruded part, such that the axial connector can be easily removed from the receiving member. Nevertheless, the engagement ball is not well positioned and may shifts or rolls out during assembling processes.

The present invention intends to provide a ball-lock axial connector assembly to eliminate the shortcomings mentioned above.

SUMMARY OF THE INVENTION

The present invention relates to a ball-lock axial connector assembly and comprises a receiving member, and a sleeve has one end received in the receiving member. The sleeve has a first passage defined axially therethrough, and at least one aperture is defined radially through the wall of the sleeve and communicates with the first passage. A bead is received in the at least one aperture from outside of the sleeve. A portion of the bead is located within the first passage. A guide face extends from the periphery of the at least one aperture and toward the receiving member. The bead is movable along the guide face.

A positioning member has a first through hole defined axially therethrough, and the positioning member is mounted to the outside of the sleeve. A push member has a second through hole defined axially therethrough. The push member is mounted to the outside of the sleeve. A first resilient member is biased between the positioning member and the push member. The push member has at least one protrusion extending axially therefrom. The at least one protrusion extends through the first through hole and contacts the bead.

A case has a second passage defined axially therethrough and has a first end movably mounted to one end of the receiving member. The sleeve, the positioning member and the push member are received in the case. An inner portion of the second end of the case contacts the push member. A second resilient member is located between the case, the bead, the sleeve and the receiving member. One end of the second resilient member contacts the bead.

When the case is moved toward the receiving member and moves the push member to push the bead, or the bead is pushed directly by a force along the axis of the sleeve, the bead moves along the guide face and is disengaged from the first passage.

Preferably, an axial connector has an insertion on one there and the outer surface of the insertion is sized to be matched with the inner periphery of the first passage of the sleeve. A groove is defined in the outer surface of the insertion so as to receive the bead.

Preferably, the positioning member has at least one notch defined in the inner periphery of the first through hole, and the at least one notch is located corresponding to the bead. The at least one protrusion extends through the at least one notch to contact the bead.

Preferably, the first resilient member is a compression spring.

Preferably, the second resilient member is a resilient washer.

Preferably, the second resilient member is a washer made by silicone rubber.

Preferably, the at least one protrusion has an end face which is a curved face matched with the bead.

Preferably, the positioning member has a slide face formed on one end thereof and the slide face is located corresponding to a movement path of the bead.

Preferably, the guide face is located beneath of the center of the bead.

Preferably, the guide face is an inclined face.

The primary object of the present invention is to provide a ball-lock axial connector assembly, when assembling the ball-lock axial connector assembly, the beads are positioned in the apertures first, the case, the push member, the positioning member, the first resilient member, the second resilient member and the sleeve can be easily installed in the receiving member, the beads do not drop off. The assembling efficiency is increased.

Another object of the present invention is to provide a ball-lock axial connector assembly, wherein the axial connector can directly inserted into the first passage of the sleeve to push the beads to move along the guide faces and to compress the second resilient member such that the beads are disengaged from the apertures. When the groove of the axial connection is positioned corresponding to the apertures, the beads are pushed back to the apertures by the second resilient member and engaged with the groove to position the axial connector. When the axial connector to be separated from the receiving member, the user simply slides the case to push the push member whose protrusions push the beads to move along the guide faces and compress the second resilient member. The beads are then disengaged from the apertures so that the axial connector can be removed from the receiving member easily.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
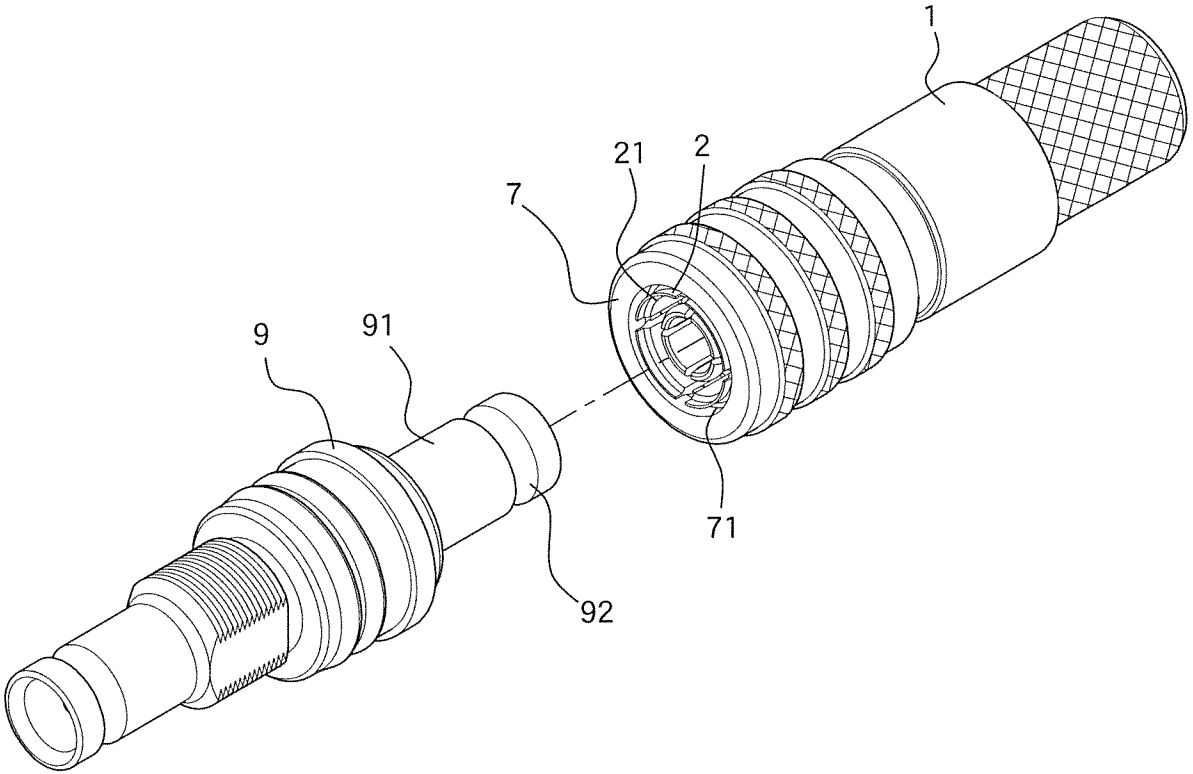
FIG. 1 is an exploded view to show the receiving member and the axial connector of the present invention.
Figure 2:
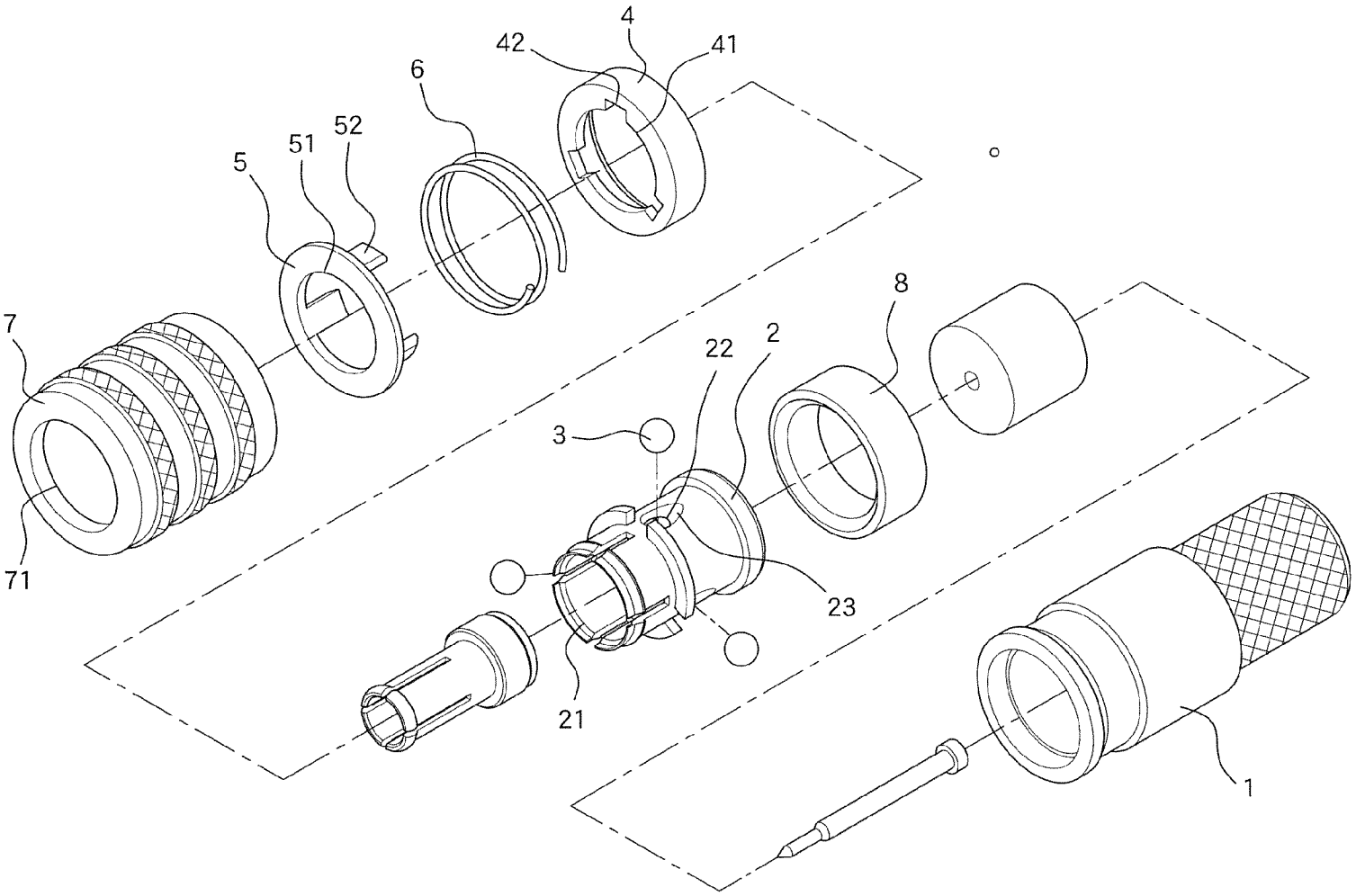
FIG. 2 is an exploded view to show the receiving member of the ball-lock axial connector assembly of the present invention.
Figure 3:
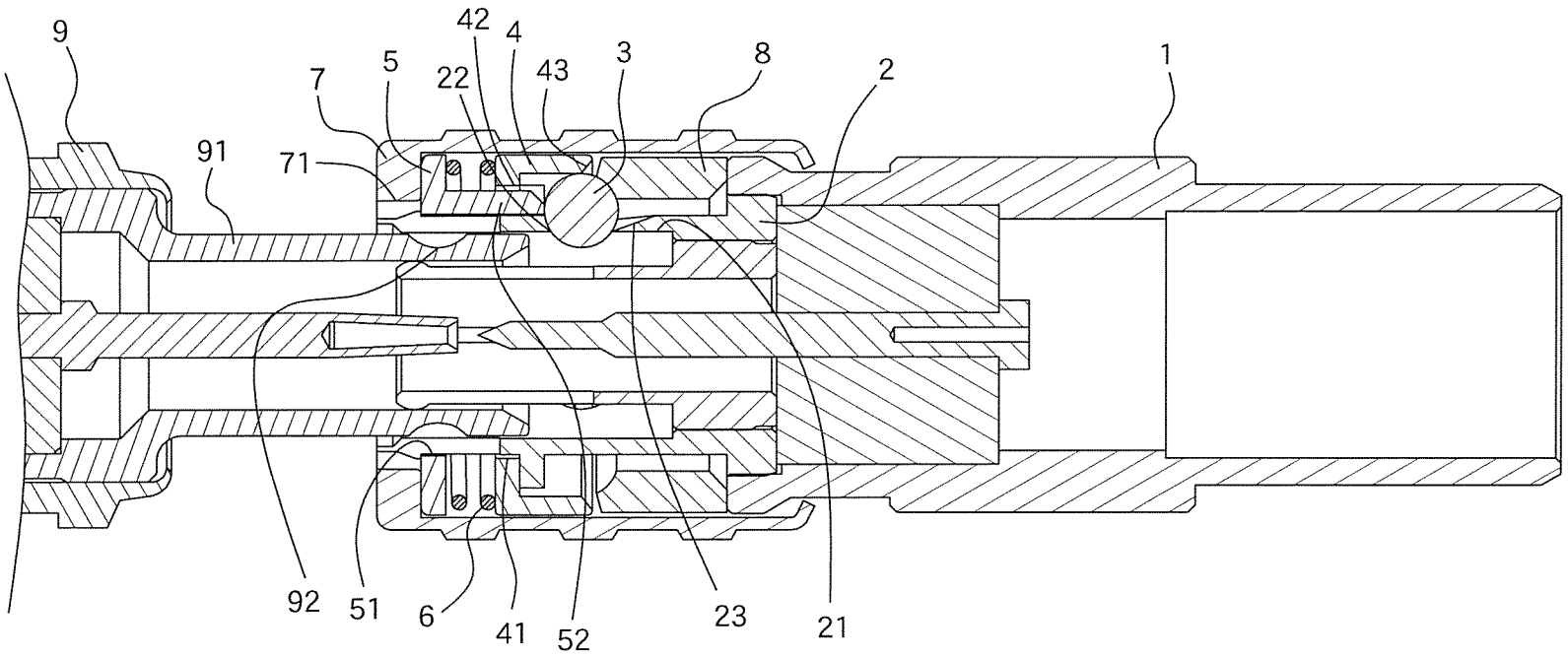
FIG. 3 is a cross sectional view to show that the axial connector begins to be inserted into the sleeve of the receiving member of the present invention.

Referring to FIGS. 1 to 3, the ball-lock axial connector assembly of the present invention comprises a receiving member 1, and a sleeve 2 has one end thereof received in the receiving member 1. The sleeve 2 has a first passage 21 defined axially therethrough. At least one aperture 22 is defined radially through the wall of the sleeve 2 and communicates with the first passage 21. In this embodiment, there are three apertures 22. Three beads 3 are received in the apertures 22 from outside of the sleeve 2 respectively. A portion of each of the beads 3 is located within the first passage 21. A guide face 23 extends from the periphery of each of the apertures 2 and toward the receiving member 1. Each bead 3 is movably along the guide face 23 corresponding thereto. The lower end of the guide face 23 is located beneath of the center of the bead 3 corresponding thereto. In this embodiment, each of the guide faces 23 is an inclined face.

A positioning member 4 is a ring-shaped member and has a first through hole 41 defined axially therethrough. The positioning member 4 is mounted to the outside of the sleeve 2. The positioning member 4 has three notches 42 defined in the inner periphery of the first through hole 41. The three notches 42 are located corresponding to the beads 3 respectively. The positioning member 4 has a slide face 43 formed on one end thereof and the slide face 43 is located corresponding to the movement path of the bead 43.

A ring-shaped push member 5 has a second through hole 51 defined axially therethrough, and the push member 5 is mounted to the outside of the sleeve 2. A first resilient member 6 is biased between the positioning member 4 and the push member 5. In this embodiment, the first resilient member 6 is a compression spring. The push member 5 has three protrusions 52 extending axially therefrom. The protrusions 52 extend through the three notches 42 and contacting the beads 3.

A case 7 has a second passage 71 defined axially therethrough, and the case 7 has a first end movably mounted to one end of the receiving member 1. The sleeve 2, the positioning member 4 and the push member 5 are received in the case 7. A flange extends inward from the inner portion of the second end of the case 7 so as to contact the push member 5. A second resilient member 8 is located between the case 7, the beads 3, the sleeve 2 and the receiving member 1. One end of the second resilient member 8 contacts the beads 3. In this embodiment, the second resilient member 8 is a resilient washer which can be made by silicone rubber.

An axial connector 9 has an insertion 91 on one end thereof and the outer surface of the insertion 91 is sized to be matched with the inner periphery of the first passage 21 of the sleeve 2. A groove 92 is defined in the outer surface of the insertion 91 so as to receive the beads 3.

Figure 4:
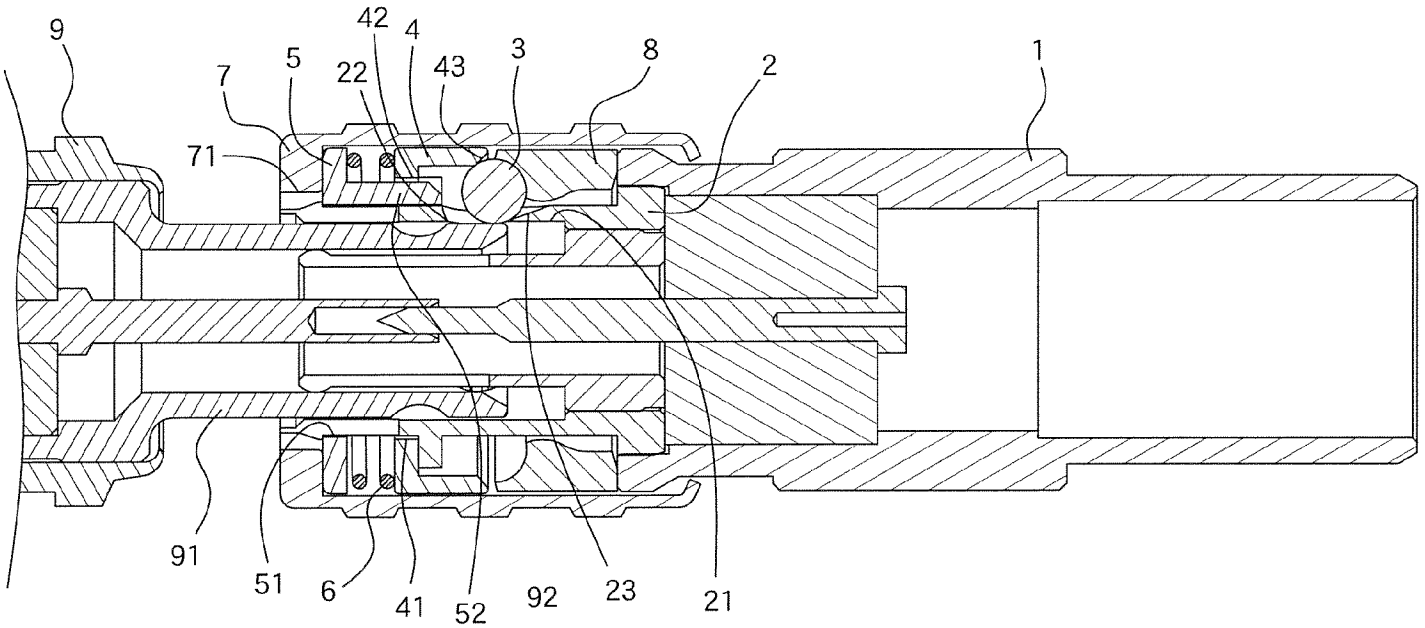
FIG. 4 is a cross sectional view to show that the axial connector is inserted into the sleeve of the receiving member of the present invention, and the beads are pushed outward by the axial connector.
Figure 5:
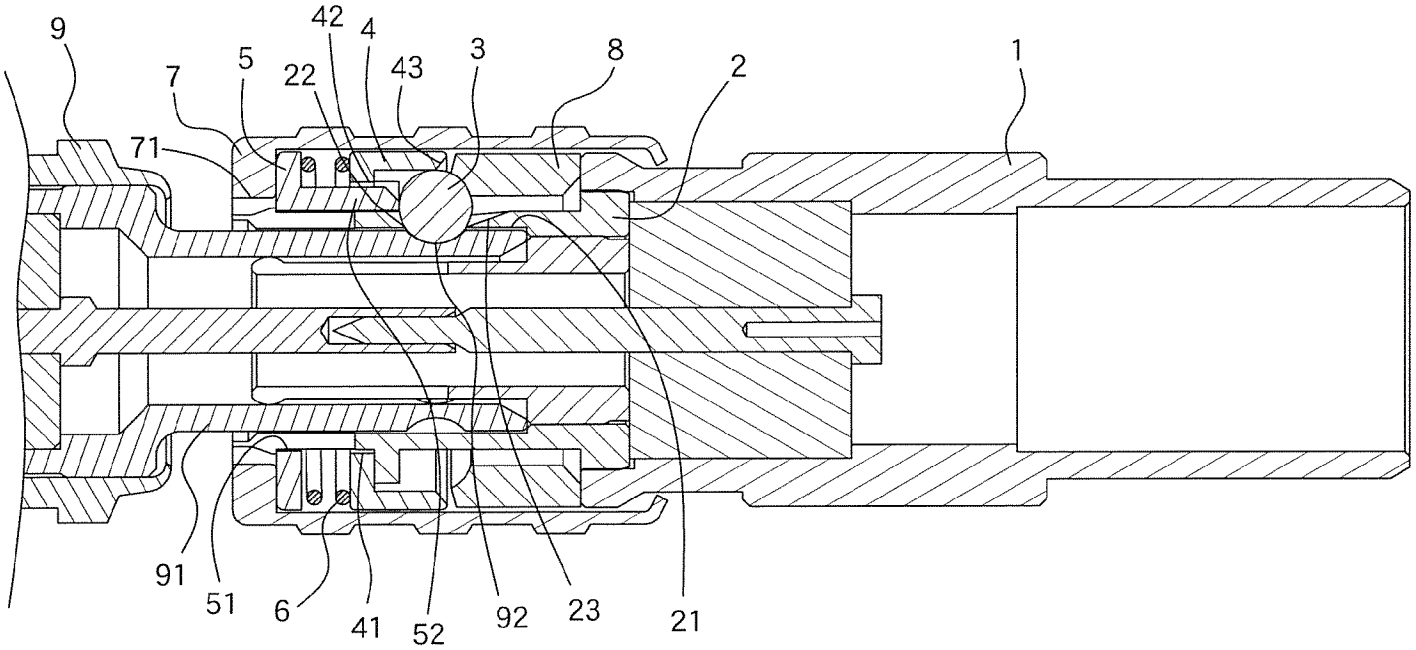
FIG. 5 is a cross sectional view to show that the axial connector is completely inserted into the sleeve of the receiving member of the present invention, and the beads are engaged with the groove of the axial connector.

FIG. 3 shows that the axial connector 9 is to be inserted into the first passage 21 of the sleeve 2. The axial connector 9 is inserted into the second passage 71, the second through hole 51, the first through hole 41 and the first passage 21 in sequence. The axial connector 9 is continuously moved forward into the first passage 21, the outer surface of the axial connector 9 push the beads 3 outward. Because the lower end of the guide face 23 is located below the center of the beads 3 so that the beads 3 are easily moved by the axial connector 9 and along the guide face 23 and toward the receiving member 1. The beads 3 compress the second resilient member 8 and are disengaged from the first passage 21 and contact the outside of the insertion 91 of the axial connector 9. Therefore, the axial connector 9 moves toward the receiving member 1 as shown in FIG. 4. The axial connector 9 is continuously moved forward into the first passage 21 until the groove 92 is moved to the apertures 22 and located corresponding to the beads 3, the beads 3 are pushed back by the second resilient member 8 and moved into the apertures 22 and engaged with the groove 92 as shown in FIG. 5. Therefore, the axial connector 9 is successfully connected to the receiving member 1.

Figure 6:
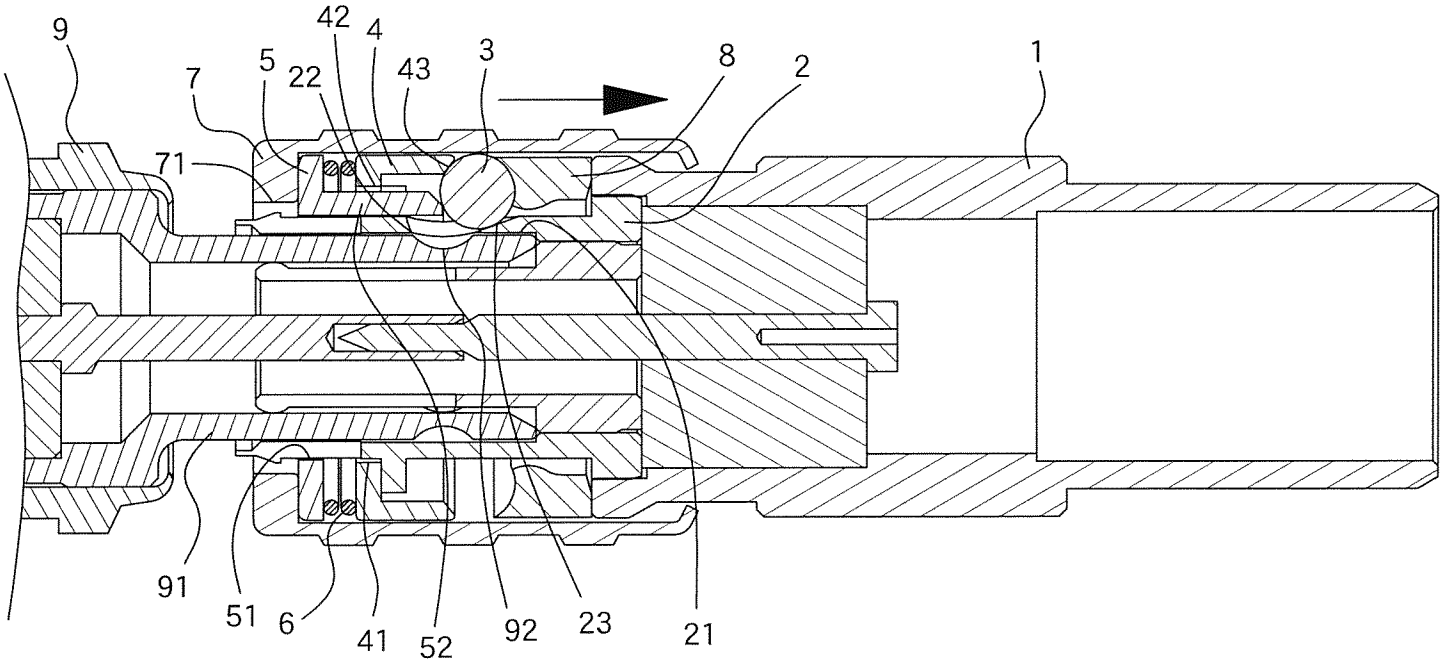
FIG. 6 is a cross sectional view to show that case is pushed to remove the beads from the apertures.

As shown In FIG. 6, when the axial connector 9 is to be removed from the receiving member 1, the user slides the case 7 toward the receiving member 1 to move the push member 5, the push member 5 pushes the first resilient member 6. The protrusion 52 of the push member 5 pushes the beads 3, the beads 3 are moved along the guide faces 23 to compress the second resilient member 8, and are disengaged from the first passage 21. Therefore, the axial connector 9 can be easily removed from the first passage 21. The axial connector 9 can be easily removed from the receiving member 1 due to no restriction from the beads 3. When no force is applied to the case 7, the first resilient member 6 pushes the push member 5 to move the push member 5 and the case 7 back to their original positions.

Alternatively, the beads 3 can be pushed directly by a force along the axis of the sleeve 2 to allow the axial connector 9 to be easily removed from the first passage 21. After the axial connector 9 is removed from the first passage 21, the beads 3 are pushed back by the second resilient member 8 and are engaged with the apertures 22 again.

It is noted that the three apertures 22 are located at even distance (120 degrees) from each other so that the beads 3 firmly and stably position the axial connector 9.

While we have shown and described the embodiment in accordance with the present invention, it should be clear to those skilled in the art that further embodiments may be made without departing from the scope of the present invention.

What is claimed is:

1. A ball-lock axial connector assembly comprising:

a receiving member;

a sleeve having one end received in the receiving member, the sleeve having a first passage defined axially therethrough, at least one aperture defined radially through a wall of the sleeve and communicating with the first passage, a bead received in the at least one aperture from outside of the sleeve, a portion of the bead located within the first passage, a guide face extending from a periphery of the at least one aperture and toward the receiving member, the bead being movably along the guide face;

a positioning member having a first through hole defined axially therethrough, the positioning member mounted to the outside of the sleeve;

a push member having a second through hole defined axially therethrough, the push member mounted to the outside of the sleeve, a first resilient member being biased between the positioning member and the push member, the push member having at least one protrusion extending axially therefrom, the at least one protrusion extending through the first through hole and contacting the bead, and a case having a second passage defined axially therethrough, the case having a first end movably mounted to one end of the receiving member, the sleeve, the positioning member and the push member received in the case, an inner portion of a second end of the case contacting the push member, a second resilient member located between the case, the bead, the sleeve and the receiving member, one end of the second resilient member contacting the bead, when the case is moved toward the receiving member and moves the push member to push the bead, or the bead is pushed directly by a force along an axis of the sleeve, the bead moves along the guide face and is disengaged from the first passage.

2. The ball-lock axial connector assembly as claimed in claim 1 further comprising an axial connector which has an insertion on one end of the axial connector, an outer surface of the insertion is sized to be matched with an inner periphery of the first passage of the sleeve, a groove is defined in the outer surface of the insertion so as to receive the bead.

3. The ball-lock axial connector assembly as claimed in claim 1, wherein the positioning member has at least one notch defined in an inner periphery of the first through hole, the at least one notch is located corresponding to the bead, the at least one protrusion extends through the at least one notch to contact the bead.

4. The ball-lock axial connector assembly as claimed in claim 1, wherein the first resilient member is a compression spring.

5. The ball-lock axial connector assembly as claimed in claim 1, wherein the second resilient member is a resilient washer.

6. The ball-lock axial connector assembly as claimed in claim 5, wherein the second resilient member is a washer made by silicone rubber.

7. The ball-lock axial connector assembly as claimed in claim 1, wherein the at least one protrusion has an end face which is a curved face matched with the bead.

8. The ball-lock axial connector assembly as claimed in claim 1, wherein the positioning member has a slide face formed on one end thereof and the slide face is located corresponding to a movement path of the bead.

9. The ball-lock axial connector assembly as claimed in claim 1, wherein a lower end of the guide face is located beneath of a center of the bead.

10. The ball-lock axial connector assembly as claimed in claim 1, wherein the guide face is an inclined face.

* * * * *